United States Patent [19]

Almgren

[11] 4,127,340

[45] Nov. 28, 1978

[54] MOVABLE HINGE BINDER

[75] Inventor: Robert E. Almgren, Chatham, N.J.

[73] Assignee: American Loose Leaf Corp., Clifton, N.J.

[21] Appl. No.: 830,969

[22] Filed: Sep. 6, 1977

Related U.S. Application Data

[63] Continuation of Ser. No. 629,578, Nov. 6, 1975, abandoned.

[51] Int. Cl.[2] ..... B42F 13/14

[52] U.S. Cl. ..... 402/44; 402/75; 402/80 R

[58] Field of Search ..... 402/43, 44, 45, 31, 402/33, 75, 80 R; 206/453

[56] References Cited

U.S. PATENT DOCUMENTS

| | | | |
|---|---|---|---|
| 2,791,220 | 5/1957 | McBee | 402/44 |
| 3,748,051 | 7/1973 | Frank | 402/44 |

FOREIGN PATENT DOCUMENTS

| | | | |
|---|---|---|---|
| 174,735 | 9/1906 | Fed. Rep. of Germany | 402/44 |
| 1,336,765 | 7/1963 | France | 402/44 |

*Primary Examiner*—Leonidas Vlachos

*Attorney, Agent, or Firm*—Stephen E. Feldman; Marvin Feldman

[57] ABSTRACT

A binder mechanism having two longitudinal bars on which the page holding prongs are mounted. The bars are interconnected by two rectangular movable hinge members situated proximate opposite ends of the bars. The hinge members which have two right angle sections interconnected by a piano hinge are rotatably connected to the bars and define a rectangular box-shaped structure with the bars when the binder is in the locked position. Both hinge members and bars have a thin rectangular cross-section, the long dimension of which is vertically oriented when the hinge members and the bars are in the locked position. The hinge members pivot about pins which interconnect the hinge members to the bars to rotate to an open position with the piano hinge rotated 90°. One hinge member then rotates about the piano hinge to open the binder so that the longitudinal bars are in a horizontal position and the prongs are vertically disposed. In this position, pages can be removed and inserted. A suitable locking mechanism is provided to releasably secure one of the supports to the backbone of the binder.

11 Claims, 9 Drawing Figures

MOVABLE HINGE BINDER

This is a continuation of application Ser. No. 629,578 filed Nov. 6, 1975 and now abandoned.

FIELD OF THE INVENTION

This invention relates to prong type binders and especially to prong binders which have movable hinge members.

BACKGROUND OF THE INVENTION

Prong binders are loose leaf binders that have curved arcuate prongs which each extend from one cover to the other through the entire sheaf of pages.

These binders have the advantage of being able to hold a greater number of pages than ordinary ring binders without fraying the pages. They are able to hold almost as many pages as straight post binders, but have the advantage of being able, because of the curvature of the prongs, to be placed in a position where the pages can be easily read.

The difficulty with prong binders is that the mechanism to open the prongs is quite complex and unwieldy. One of the most common mechanisms is a hinge which is located along the center of the backbone with the backbone folding to open the prongs. Such a mechanism is shown in U.S. Pat. No. 1,812,435. The problem with this type of mechanism is that it is not pleasing esthetically, requires difficult locking mechanism and it is very difficult to place printing, such as the title of the book, on the backbone, because the hinge splits the backbone into two thin sections.

Thus, there has been a desire to produce a prong binder which has a solid backbone, which does not fold or split. One such binder that lacks a folding backbone is constructed so that at least one of the supports which hold the prongs, disconnects from one side of the binder in order for the prongs to be opened without folding the backbone. This mechanism is shown in U.S. Pat. No. 2,791,220 (McBee). The mechanism provides two longitudinal supports, each of which supports two of the four prongs and one of which is detachably connected to a cover of the binder. In order to open and close the binder, the mechanism uses two hinges which connect the longitudinal supports to open and close the prongs. The hinges are "V" shaped in construction, with a single rivet connecting their two sections. They rotate from a flat horizontal position against the backbone of the binder to an upright position. In a flat horizontal position, the mechanism is closed and locked. When one of the supports is detached from the side wall, the hinges are then swung underneath to the upright position and the binder is opened. The problem with the mechanism is that the hinges are structurally weak. When the hinges are in the horizontal position, the supports can be shifted longitudinally with respect to each other with the hinges offering very little resistance to such shifting. This shifting causes bending and distortion of the hinges and possible breaking of the hinge rivet, all of which results in improper operation or non-operation of the mechanism. Also, when a hinge is swung to the upright position so that the binder can be opened, the weight of the free support is placed on the hinge in a manner such that a slight shifting of the support would tend to bend the hinge or break the hinge rivet and cause misalignment or improper operation of the mechanism. The problem is that by having the flat construction of the hinges with a single rivet on an axis perpendicular to the flat surface of the hinges, the forces on the hinge during their operation tend to bend and twist the hinges and cause their misalignment. The situation is also aggravated as there is nothing other than the single rivets to hold the two longitudinal supports in proper alignment. Because of this, there was a tendancy as the binder was in use for the prong bars to be shifted longitudinally so that the prongs were no longer in proper alignment.

The desire, therefore, was to have a binder mechanism whereby the hinges would support and keep the two longitudinal bars in proper parallel alignment with the hinges constructed so that they resist bending and misalignment when rotated between the open and closed positions.

SUMMARY OF THE INVENTION

Accordingly, it is an object of this invention to provide a new and improved binder construction for a prong-type binder which incorporates hinge members which support and hold the two longitudinal prong bars in proper alignment.

Another object of the present invention is to provide such a binder whereby the hinge members are positioned in the closed configuration so that they form a box-like structure with the two prong bars.

Another object of this invention is to provide such a binder where piano-type hinges connect the hinge members together.

A still further object of this invention is to provide such a binder whereby the hinge members are of a right angular type construction.

A still further object of this invention is to provide such a binder whereby when the hinges are swung to the open position the stronger dimension of the hinge members are parallel to the longitudinal supports to provide a strengthened configuration, to prevent bending and twisting of the hinge members.

The present invention contemplates a prong binder having two longitudinal bars each of which support two of the prongs and one of which is detachably connected to connecting means which is attached to the side wall of the binder. The bars are interconnected by two right angular hinge members which are connected by piano type hinges and which, in the closed position are oriented to form a box-like structure with the two supports and in their open configuration present the longer cross sectional dimension parallel to the longitudinal bars to strengthen the configuration and prevent distortion of the hinges.

PREFERRED EMBODIMENT OF THE INVENTION

Figure 1:
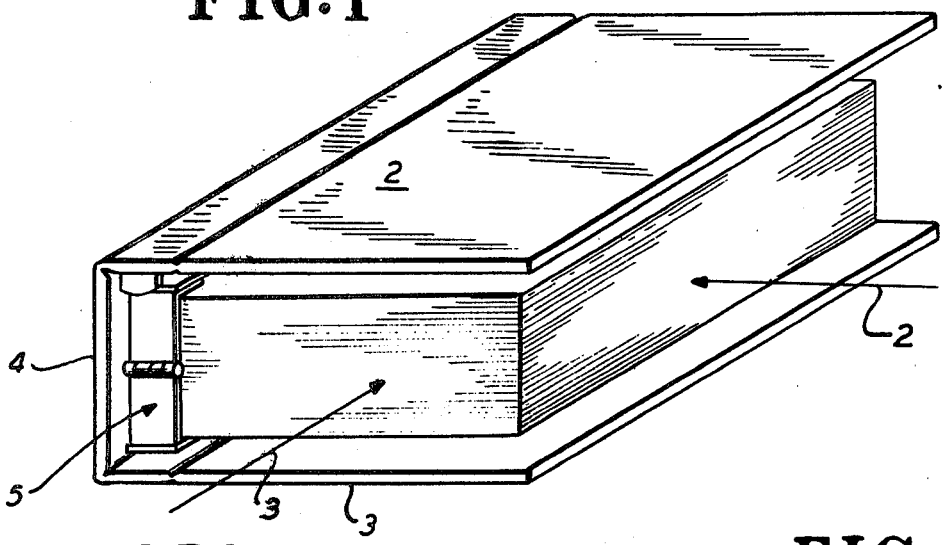
FIG. 1 is a perspective view of the binder mechanism of this invention.
Figure 2:
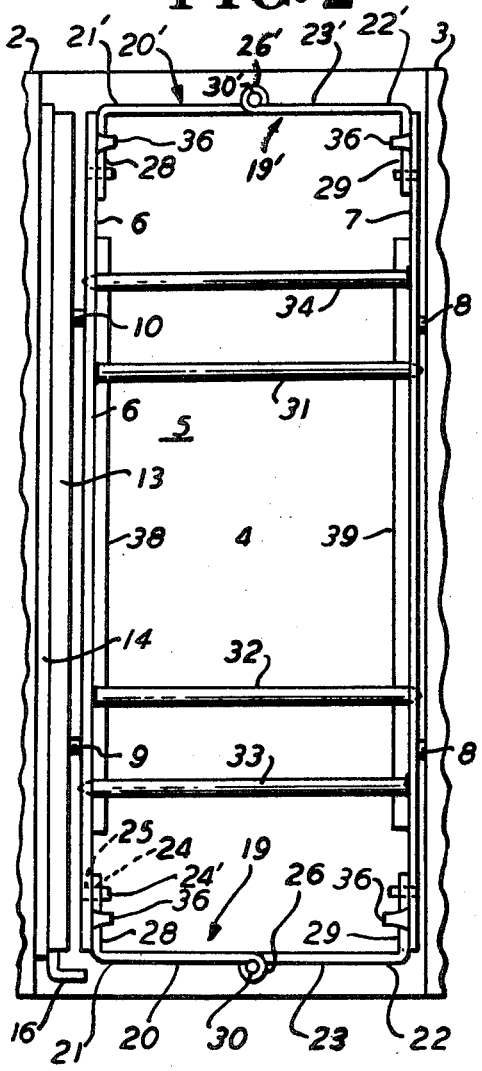
FIG. 2 is a plan view of the binder mechanism in the closed (locked) position with the covers partially removed in the direction of arrow 2.
Figure 3:
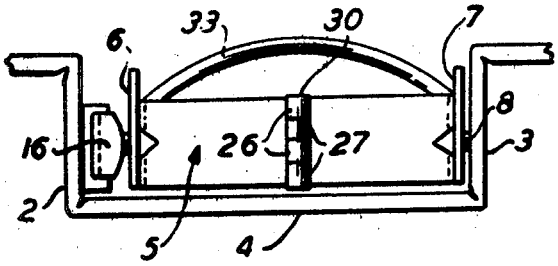
FIG. 3 is a side view of the binder of FIG. 1 in the direction of arrow 3.

Referring now to the drawings, in particular to FIGS. 1, 2 and 3 wherein the mechanism comprises covers 2 and 3, a backbone 4 and a binding mechanism 5. Pages are also shown in place in the binder. Binding mechanism 5 consists of two longitudinal prong bars 6 and 7 or support members (FIG. 2). Bars 6 and 7, which are often referred to as "metals" are attached to the covers 2 and 3 of the binder. Bar 7 is permanently attached by rivets 8, or other suitable means to cover 3. Bar 6, on the other hand, is detachably connected to cover 2, and has two horizontally disposed projections 9 and 10 extending therefrom. Projections 9 and 10 are cylindrical, each tapering to a point and having a notch (FIG. 5) thereon. Projections 9 and 10 fit into apertures 11 and 12 respectively (FIG. 8) of a connecting mechanism 13 (which is attached to cover 2) to connect bar 6 to cover 2.

Figure 8:
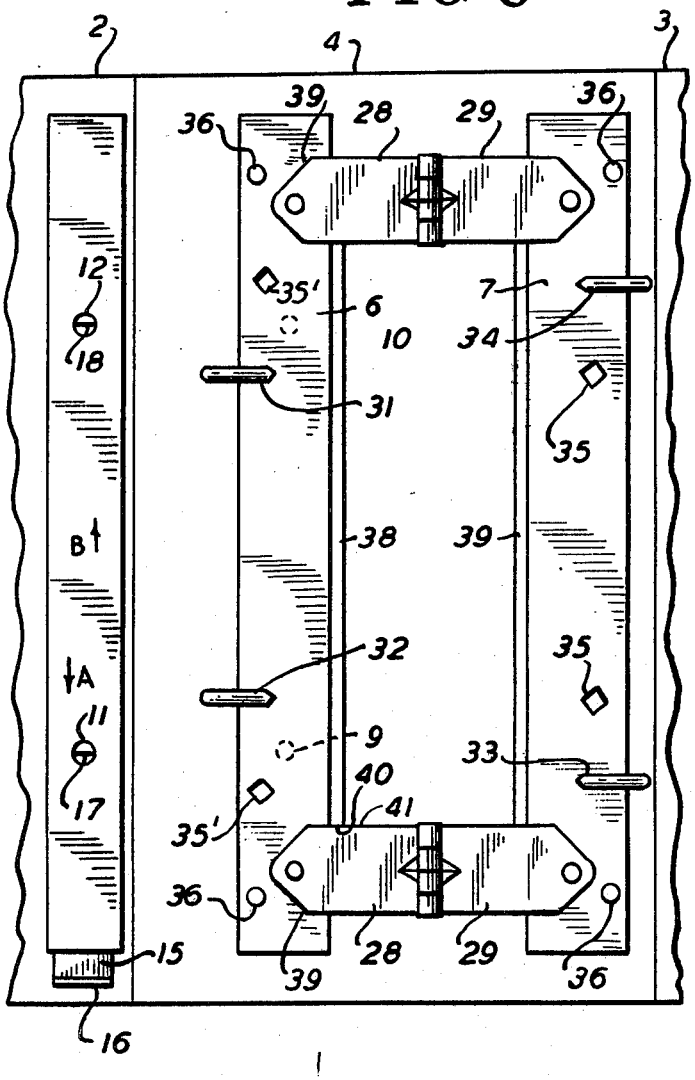
FIG. 8 is a plan view of the binder in the open position as shown in FIG. 7.

Connecting mechanism 13, which, it will be appreciated, is only one of many that are known in the art, consists of a thin plate 14 (FIG. 2) attached to cover 2 by subtle means. A slide member 15 having an upwardly projecting tab 16 is positioned on member 14. Slide member 15, which is spring biased (not shown), has two openings having flat edges 17 and 18. The spring biasing causes slide member 15 to be biased to a closed position, that is, towards the bottom of the sheat of drawing in FIG. 2 (in the direction of arrow A.) This causes flat edges 17 and 18 of slide 15 to partially close apertures 11 and 12 of mechanism 13 (as shown in FIG. 8) and to fit into the notches in projections 9 and 10 to hold prong bar 6 to cover 2 of the binder.

When it is desired to release prong bar 6 from cover 2, slide 15 is pushed upwardly (in the direction of arrow B—FIG. 8) by pressing against projecting tab 16. This action moves slide 15 against its biasing spring so that edges 17 and 18 on slide 15 are removed from the notches on projections 9 and 10 to disconnect prong bar 6 from cover 2 so that binding mechanism 5 can be opened (as will be discussed subsequently).

Connecting bars 6 and 7 together are rotatable hinge members 19, 19' (FIG. 2) which are respectively secured to prong bars 6 and 7 proximate the ends thereof as will be hereinafter described. Each hinge member 19, 19' is constructed of thin sections of metal (such as steel) and includes a pair of right angle sections 21, 22 and 21', 22' respectively. Each right angle section 21, 22, 21', 22' is reinforced proximate its center by an indentation 23 (FIG. 4A) for strength and to enable it to withstand greater forces. A connecting tab 21' forms a leg of each right angle section 21, 21'; while a connecting tab 29, forms one leg of each right angle section 22, 22'. An opening 24 is formed in each connecting tab 28, 29 to receive a rivet 24'; each such rivet 24' in turn also passing through a corresponding opening 25 formed in prong bars 6 and 7 respectively. Rivets 24' are secured in place so that hinge members 19, 19' can rotate with respect to bars 6 and 7 as will be hereinafter described. The other leg of each right angle section 21, 21' consists of a flat section 20, 20', which terminates in curved cylindrical like projections 26, 26'; similarly the other leg 23, 23' of each right angle section 22, 22' terminates in curved cylindrical like projections 27, 27'. Projections 26, 26' intermesh with projections 27, 27', respectively to form piano like hinges which are connected together by hinge pins 30, 30' respectively.

Each prong bar 6 and 7 has two prongs connected to it. The two inner prongs 31, 32, (FIG. 2) which are the ones shown closest to each other, are connected to prong bar 6. The other two prongs 33, 34, the outer two prongs shown, are connected to prong bar 7. Prongs 31, 32, 33 and 34 are curved as more clearly shown in FIGS. 3–7 and each includes a tapered tip. Prongs 31, 32, 33 and 34 are each permanently fastened at one of their ends to their respective bars 6 and 7 such as by welding, brazing, riveting, etc.

In the closed position of the binding mechanism 5, the tapered tips of prongs 31, 32, 33, 34 fit respectively into diamond shaped openings 35 and 35' in prong bars 6 and 7 (FIG. 8). These diamond shaped openings hold the prongs securely in position and can be other than diamond shaped if desired.

In its typical use the binder is used to hold a plurality of pages of paper, as shown in FIG. 1, each of which has holes corresponding to the number of prongs; in this case four. The binder is normally used with binding mechanism 5 in the locked position of FIGS. 2 and 3; and with covers 2 and 3 opened and the pages turned in a normal reading position. In this position hinge members 19 and 19' are oriented with the piano-hinge and their longer cross-section perpendicular to backbone 4 of the binder (FIGS. 2 and 3). Prong bars 6 and 7 are similarly perpendicularly oriented to form what might be considered a rectangular box-like structure, which is extremely rigid. Part of this rigidity is due to the right angle shape of hinge members 19, 19' and the fact that sections of each of the hinge members 19, 19' are positioned parallel with and against prong bars 6 and 7. That is, tabs 28 of hinge members 21, 21' overlap with part of prong bar 6; and tabs 29 of hinge members 22, 22' overlap with part of prong bar 7. This forms a very secure and strong construction.

Figure 4:
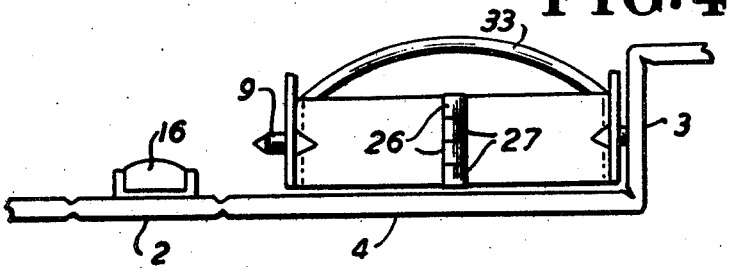
FIG. 4 is the same view as FIG. 3 with one of the support members detached from the cover.
Figure 4A:
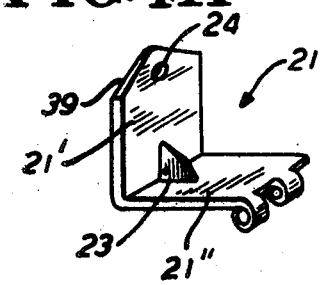
FIG. 4A is a view of a section of a hinge member.

It will be appreciated that in this position hinge members 19, 19' cannot pivot downwardly about rivets 24' since they are being held in position by the backbone 4 of the binder against which they rest. Hinge member 19, 19' also cannot be pivoted upwardly about rivets 24' because of projections 36 which extend inwardly proximate the ends of prong bars 6, 7 and contact edges 39 on tabs 28 and 29 to prevent hinges 19, 19' from being pivoted upwardly. Thus, in the locked position, hinge members 19, 19' are locked in their vertical position and cannot bend in any manner. If one tried to move one of the prong bars 6 or 7 longitudinally with respect to the other, it would be impossible because one would then have to try and buckle hinge members 19, 19' against the resistance of their shape, especially as reinforced by indentations 23 formed therein. Indentations 23 form a 45° angle with respect to the right angles of hinge members 19, 19'. This is shown in FIG. 4A. Thus, a very strong configuration results in the locked condition.

To further ensure that the binder properly seats against backbone 4 and does not cut into it, there are two horizontal flanges 38 and 38', each projecting inwardly from a lower edge of each prong bar 6 and 7. Flanges 38, 38' increase the cross sectional strength of prong bars 6, 7.

Figure 5:
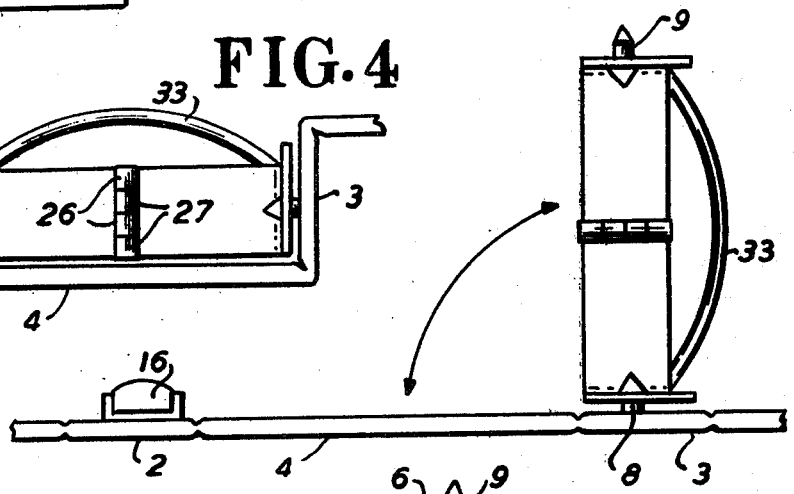
FIG. 5 is the same view as FIG. 3 with the binding mechanism rotated to the position in anticipation of opening the mechanism.

When it is desired to open the binder such as when pages are to be inserted, removed or both inserted and removed, slide member 15 is pressed by pushing on tab 16 to release bar 6 from cover 2 as previously discussed. This permits cover 2 to be lowered to a horizontal position as shown in FIG. 4. The binder mechanism is still quite rigid because of the square box-like configuration previously mentioned (whereby hinge members 19, 19' and prong bars 6, 7 together form a rectangular enclosure). The binder mechanism is then moved to the position as shown in FIG. 5. This is easily done by grasping either one of the hinge members 19, 19', the bars 6, 7; prongs 31, 32, 33 or 34 or cover 3 and moving cover 3 to the position shown in FIG. 5. The box-like structure aforementioned is especially important when the binder is moved to this position, since without this structure, bending and distortion of hinge members 19, 19' could occur during this movement.

Figure 6:
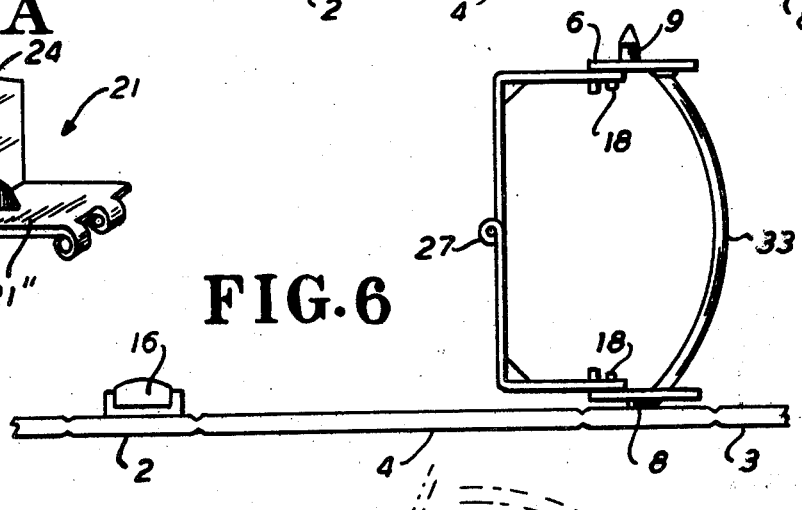
FIG. 6 is the same view as FIG. 3 with the mechanism moved to a position where they can be rotated to the open position.
Figure 7:
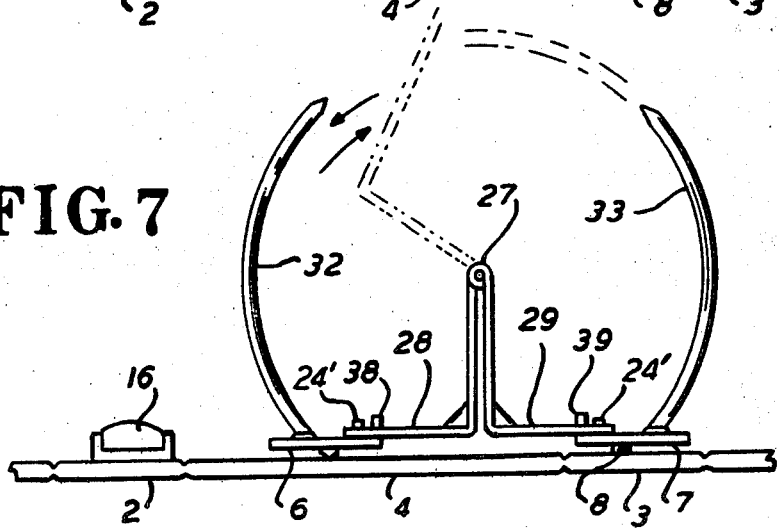
FIG. 7 is the same view as FIG. 3 with the hinge member rotated to the open position.

The next step in opening the binder, as shown in FIG. 6, is for hinge members 19, 19' to be rotated inwardly about rivets 24' so that hinge members 19, 19' assume the position as shown in FIG. 6. To ensure that hinge members 19, 19' are not rotated further than 90° (that is, further than the position of FIG. 6 where hinge members 19, 19' are essentially perpendicular to bars 6 and 7), surfaces 41 of tabs 28, 29 contact edges 40 of flanges 38 and 39 to prevent further rotation (see FIG. 8), of the hinge members 19, 19'. If they were rotated further than 90° the hinge pins 30, 30' would not be aligned on the same axis and the hinges could not be rotated. The hinge pins must be aligned axially for the hinges to be opened and closed. Referring back to the operation, prong bar 6 is now rotated about an arc as shown by the dotted lines in FIG. 7 until the projections 9 and 10 touch backbone 4 of the binder. In this position, prong bar 6 will be in a substantially horizontal position. Both sets of prongs 31, 32 and 33, 34 will now in be in a somewhat vertical position. In this condition, the entire binder is in the open position with the prongs positioned far enough apart so that pages may now be quickly inserted or removed from the binder. After the pages are inserted or removed, the process is reversed to close the binder. That is, prongs 32 and 31 and bar 6 are rotated about pins 30 as shown by the dotted lines in FIG. 7 to the position shown in FIG. 6. At this point hinge members 19, 19' are rotated inwardly about rivets 24' to the position as shown in FIG. 5. The binder mechanism is now rotated downwardly as shown by the arrows in FIG. 5 to the position of FIG. 4. Cover wall 2 and its connecting means are now rotated upwardly to the position of FIG. 3 so that projections 9 and 10 on bar 6 will fit into holes 11 and 12 to connect and lock bar 6 to cover 2. The binder will now be in the closed position as shown in FIGS. 2 and 3. The covers can then be closed so that the mechanism is in the position of FIG. 1.

It will be appreciated that the binder mechanism and the connecting means may be made out of steel, metal or other suitable material. The binder itself can be made out of vinyl, plastic, cardboard covered with vinyl, plastic or any other suitable material. The number and type of prongs and their position, of course, may vary depending on the mechanism. If desired, split prongs such as formed on a ring binder (which connect with each other) can be provided. Also, another slide lock can be provided on the other side of the hinge mechanism so that the hinge mechanism can be removed entirely from the binder covers.

While a preferred embodiment of the invention has been described, it will be apparent to one skilled in the art that many changes and modifications can be made which come within the true spirit and scope of the invention.

I claim:

1. A binder mechanism for a loose leaf binder for holding pages in the binder, including a cover and backbone comprising:

support members carried by said cover and backbone;

prongs, for holding pages, projecting from said support members;

hinge means interconnecting said support members, said hinge means including at least two interconnected substantially right angular sections, each said right angular section including first and second perpendicular legs, said first legs being hingedly connected to each other and said second legs being connected to said supports;

rotative means being mounting said hinge means for rotation with respect to said support members and so as to permit rotation of said hinge means between a closed position for the binder mechanism wherein the prongs are closed and an open position for the binder mechanisms wherein the prongs are open and pages can be inserted;

said interconnection between said first legs being such that when said first legs are in said closed position said first legs are disposed in a first plane that is perpendicular to both a second plane within which the backbone of the binder is disposed and third and forth plane within which said support members lie;

said interconnection between said first legs furthermore being such that when said first legs are in said open position said first legs are disposed in a fifth plane that is perpendicular to said second plane within which the backbone is disposed, said support members being disposed in a sixth plane parallel to said second plane within which said backbone is disposed when said first legs are in said open position.

2. The binder mechanism of claim 1, wherein said hinge means comprises two hinge members each of which includes said two right angular sections, said first legs of the right angular sections, of each hinge member being interconnected by hinge pins said hinge pins being parallel with respect to each other in said closed position of the binder, and being co-axial with respect to each other in said open position of the binder.

3. The binder mechanism of claim 2, wherein said right angular sections include curved interfitting piano type projections which are interconnected by said hinge pins.

4. The binder mechamism of claim 3, including limiting means to limit the rotation of said hinge means.

5. The binder mechanism of claim 4, wherein said limiting means includes a projection extending perpendicularly from a support member, said projection contacting a first edge of said second leg on a right angular section of a hinge member to prevent rotation of said hinge means while in said closed position.

6. The binder mechanism of claim 5, including a second limiting means comprising an extending edge of a support member which contacts a seconds edge of a second leg of a right angular section of a hinge member to limit rotation of said hinge means while in said open position.

7. The binder mechanism of claim 6, wherein a reinforcing indent is included in the right angle of each of said right angular sections.

8. The binder mechanism of claim 7, including two support members, one of which is detachably connected to the cover of said binder.

9. The binder mechanism of claim 8, including two prongs projecting from one of said support members toward the other of said support members and two prongs extending toward said one support member and projecting from said other of said support member.

10. The binder mechanism of claim 2, wherein said support members and said right angular sections of said hinge means form a rectangular box configuration in said closed position of said hinge means.

11. The binder mechanism of claim 2, wherein said hinges rotate toward each other in rotating from said closed position of the mechanism to said open position of the mechanism.

* * * * *